US008550190B2

(12) United States Patent
Hall et al.

(10) Patent No.: US 8,550,190 B2
(45) Date of Patent: Oct. 8, 2013

(54) INNER BIT DISPOSED WITHIN AN OUTER BIT

(76) Inventors: David R. Hall, Provo, UT (US); Francis Leany, Salem, UT (US); Casey Webb, Spanish Fork, UT (US); Marcus Skeem, Sandy, UT (US)

( * ) Notice: Subject to any disclaimer, the term of this patent is extended or adjusted under 35 U.S.C. 154(b) by 434 days.

(21) Appl. No.: 12/894,371

(22) Filed: Sep. 30, 2010

(65) Prior Publication Data

US 2011/0240366 A1 Oct. 6, 2011

Related U.S. Application Data

(63) Continuation-in-part of application No. 12/752,323, filed on Apr. 1, 2010, and a continuation-in-part of application No. 12/755,534, filed on Apr. 7, 2010, now abandoned, and a continuation-in-part of application No. 12/828,287, filed on Jun. 30, 2010.

(51) Int. Cl.
*E21B 10/26* (2006.01)

(52) U.S. Cl.
USPC ..... 175/385; 175/390

(58) Field of Classification Search
USPC ..... 175/96, 305, 385, 390
See application file for complete search history.

(56) References Cited

U.S. PATENT DOCUMENTS

| | | | |
|---|---|---|---|
| 616,118 | A | 12/1889 | Kunhe |
| 465,103 | A | 12/1891 | Wegner |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford |
| 2,169,223 | A | 8/1931 | Christian |
| 1,821,474 | A | 9/1931 | Mercer |
| 1,879,177 | A | 9/1932 | Gualt |
| 2,054,255 | A | 9/1936 | Howard |
| 2,064,255 | A | 12/1936 | Garfield |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | Kammerer |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |

(Continued)

*Primary Examiner* — Brad Harcourt
(74) *Attorney, Agent, or Firm* — Philip W. Townsend, III

(57) ABSTRACT

In one aspect of the present invention, a drill bit assembly for downhole drilling comprises an outer bit comprising a central axis and an outer cutting area and an inner bit disposed within the outer bit and comprising an inner cutting area. The outer bit comprises a first plurality of cutting elements and the inner bit comprises a second plurality of cutting elements wherein an average distance of each cutting element in the first plurality to the central axis forms a first moment arm and an average distance of each cutting element in the second plurality to the central axis forms a second moment arm. A ratio of the inner cutting area to the outer cutting area is substantially equal to a ratio of the outer moment arm to the inner moment arm.

15 Claims, 10 Drawing Sheets

(56) References Cited

U.S. PATENT DOCUMENTS

| | | | |
|---|---|---|---|
| 2,963,102 | A | 12/1960 | Smith |
| 3,135,341 | A | 6/1964 | Ritter |
| 3,294,186 | A | 12/1966 | Buell |
| 3,301,339 | A | 1/1967 | Pennebaker |
| 3,379,264 | A | 4/1968 | Cox |
| 3,429,390 | A | 2/1969 | Bennett |
| 3,493,165 | A | 2/1970 | Schonfield |
| 3,583,504 | A | 6/1971 | Aalund |
| 3,764,493 | A | 10/1973 | Rosar |
| 3,821,993 | A | 7/1974 | Kniff |
| 3,955,635 | A | 5/1976 | Skidmore |
| 3,960,223 | A | 6/1976 | Kleine |
| 4,081,042 | A | 3/1978 | Johnson |
| 4,096,917 | A | 6/1978 | Harris |
| 4,106,577 | A | 8/1978 | Summers |
| 4,176,723 | A | 12/1979 | Arceneaux |
| 4,253,533 | A | 3/1981 | Baker |
| 4,280,573 | A | 7/1981 | Sudnishnikov |
| 4,304,312 | A | 12/1981 | Larsson |
| 4,307,786 | A | 12/1981 | Evans |
| 4,397,361 | A | 8/1983 | Langford |
| 4,416,339 | A | 11/1983 | Baker |
| 4,445,580 | A | 5/1984 | Sahley |
| 4,448,269 | A | 5/1984 | Ishikawa |
| 4,499,795 | A | 2/1985 | Radtke |
| 4,531,592 | A | 7/1985 | Hayatdavoudi |
| 4,535,853 | A | 8/1985 | Ippolito |
| 4,538,691 | A | 9/1985 | Dennis |
| 4,566,545 | A | 1/1986 | Story |
| 4,574,895 | A | 3/1986 | Dolezal |
| 4,640,374 | A | 2/1987 | Dennis |
| 4,852,672 | A | 8/1989 | Behrens |
| 4,889,017 | A | 12/1989 | Fuller |
| 4,962,822 | A | 10/1990 | Pascale |
| 4,981,184 | A | 1/1991 | Knowlton |
| 5,009,273 | A | 4/1991 | Grabinski |
| 5,027,914 | A | 7/1991 | Wilson |
| 5,038,873 | A | 8/1991 | Jurgens |
| 5,119,892 | A | 6/1992 | Clegg |
| 5,141,063 | A | 8/1992 | Quesenbury |
| 5,186,268 | A | 2/1993 | Clegg |
| 5,222,566 | A | 6/1993 | Taylor |
| 5,255,749 | A | 10/1993 | Bumpurs |
| 5,265,682 | A | 11/1993 | Russell |
| 5,361,859 | A | 11/1994 | Tibbitts |
| 5,410,303 | A | 4/1995 | Comeau |
| 5,417,292 | A | 5/1995 | Polakoff |
| 5,423,389 | A | 6/1995 | Warren |
| 5,507,357 | A | 4/1996 | Hult |
| 5,560,440 | A | 10/1996 | Tibbitts |
| 5,568,838 | A | 10/1996 | Struthers |
| 5,655,614 | A | 8/1997 | Azar |
| 5,678,644 | A | 10/1997 | Fielder |
| 5,732,784 | A | 3/1998 | Nelson |
| 5,794,728 | A | 8/1998 | Palmberg |
| 5,896,938 | A | 4/1999 | Moeny |
| 5,947,215 | A | 9/1999 | Lundell |
| 5,950,743 | A | 9/1999 | Cox |
| 5,957,223 | A | 9/1999 | Doster |
| 5,957,225 | A | 9/1999 | Sinor |
| 5,967,247 | A | 10/1999 | Pessier |
| 5,979,571 | A | 11/1999 | Scott |
| 5,992,547 | A | 11/1999 | Caraway |
| 5,992,548 | A | 11/1999 | Silva |
| 6,021,859 | A | 2/2000 | Tibbitts |
| 6,039,131 | A | 3/2000 | Beaton |
| 6,131,675 | A | 10/2000 | Anderson |
| 6,150,822 | A | 11/2000 | Hong |
| 6,186,251 | B1 | 2/2001 | Butcher |
| 6,202,761 | B1 | 3/2001 | Forney |
| 6,213,226 | B1 | 4/2001 | Eppink |
| 6,223,824 | B1 | 5/2001 | Moyes |
| 6,269,893 | B1 | 8/2001 | Beaton |
| 6,296,069 | B1 | 10/2001 | Lamine |
| 6,340,064 | B2 | 1/2002 | Fielder |
| 6,364,034 | B1 | 4/2002 | Schoeffler |
| 6,394,200 | B1 | 5/2002 | Watson |
| 6,439,326 | B1 | 7/2002 | Huang |
| 6,474,425 | B1 | 11/2002 | Truax |
| 6,484,825 | B2 | 11/2002 | Watson |
| 6,510,906 | B1 | 1/2003 | Richert |
| 6,513,606 | B1 | 2/2003 | Krueger |
| 6,533,050 | B2 | 3/2003 | Molloy |
| 6,594,881 | B2 | 7/2003 | Tibbitts |
| 6,601,454 | B1 | 8/2003 | Botnan |
| 6,622,803 | B2 | 9/2003 | Harvey |
| 6,668,949 | B1 | 12/2003 | Rives |
| 6,729,420 | B2 | 5/2004 | Mensa-Wilmot |
| 6,732,817 | B2 | 5/2004 | Dewey |
| 6,822,579 | B2 | 11/2004 | Goswami |
| 6,929,076 | B2 | 8/2005 | Fanuel |
| 6,953,096 | B2 | 10/2005 | Glenhill |
| 7,562,725 | B1 * | 7/2009 | Broussard et al. ..... 175/93 |
| 2003/0213621 | A1 | 11/2003 | Britten |
| 2004/0238221 | A1 | 12/2004 | Runia |
| 2004/0256155 | A1 | 12/2004 | Kriesels |
| 2008/0296015 | A1 * | 12/2008 | Hall et al. ..... 166/237 |

* cited by examiner

INNER BIT DISPOSED WITHIN AN OUTER BIT

CROSS REFERENCE TO RELATED APPLICATIONS

This application is a continuation in part of U.S. patent application Ser. No. 12/752,323, which was filed on Apr. 1, 2010; Ser. No. 12/755,534, which was filed on Apr. 7, 2010 now abandoned; and Ser. No. 12/828,287, which was filed on Jun. 30, 2010. All of these applications are herein incorporated by reference for all that they contain.

BACKGROUND OF THE INVENTION

The present invention relates to drill bit assemblies, specifically drill bit assemblies for use in subterranean drilling. More particularly the present invention relates to drill bits that include an inner bit. The prior art discloses drill bit assemblies comprising pilot bits.

One such pilot bit is disclosed in U.S. Pat. No. 7,207,398 to Runia et al., which is herein incorporated by reference for all that it contains. Runia et al. discloses a rotary drill bit assembly suitable for directionally drilling a borehole into an underground formation, the drill bit assembly having a bit body extending along a central longitudinal bit-body axis, and having a bit-body face at its front end, wherein an annular portion of the bit-body face is provided with one or more chip-making elements; a pilot bit extending along a central longitudinal pilot-bit axis, the pilot bit being partly arranged within the bit body and projecting out of the central portion of the bit-body face, the pilot bit having a pilot-bit face provided with one or more chip-making elements at its front end; a joint means arranged to pivotably connect the pilot bit to the bit body so that the bit-body axis and the pilot-bit axis can form a variable diversion angle; and a steering means arranged to pivot the pilot bit in order to steer the direction of drilling.

The prior art also teaches drill bit assemblies with shafts protruding from the working bit face. One such drill bit is disclosed in U.S. Pat. No. 7,360,610 to Hall et al, which is herein incorporated by reference for all that it contains. Hall et al. discloses a drill bit assembly which has a body portion intermediate a shank portion and a working portion, the working portion having at least one cutting element. A shaft is supported by the body portion and extends beyond the working portion. The shaft also has a distal end that is rotationally isolated from the body portion. The assembly comprises an actuator which is adapted to move the shaft independent of the body portion. The actuator may be adapted to move the shaft parallel, normal, or diagonally with respect to an axis of the body portion.

BRIEF SUMMARY OF THE INVENTION

In one aspect of the present invention, a drill bit assembly for downhole drilling comprises an outer bit comprising a central axis and an outer cutting area, and an inner bit disposed within the outer bit and comprising an inner cutting area. The outer bit comprises a first plurality of cutting elements and the inner bit comprises a second plurality of cutting elements wherein an average distance of each cutting element in the first plurality to the central axis forms a first moment arm and an average distance of each cutting element in the second plurality to the central axis forms a second moment arm. A ratio of the inner cutting area to the outer cutting area is substantially equal to a ratio of the outer moment arm to the inner moment arm.

The inner bit may be disposed coaxial with the outer bit and may comprise a center indenter. The outer bit may be configured to rotate in a first direction, and the inner bit may rotate in a second direction. The inner bit may protrude from the outer bit, and the outer bit's profile and a inner bit's profile may overlap. A fluid pathway may be disposed between the outer bit and the inner bit, and at least one fluid nozzle may be disposed on both the outer cutting area and the inner cutting area. At least one fluid nozzle may be incorporated in a gauge of the inner bit, and that nozzle is configured to convey fluid across a working face of the outer bit.

The inner bit may be configured to move axially with respect to the outer bit and may be rotationally isolated from the outer bit. The outer bit may be rigidly connected to a drill string and the inner bit may be rigidly connected to a torque transmitting device disposed within a bore hole of the drill string. The torque transmitting device may be configured to provide the inner bit with power such that the work done per unit area of the inner bit is greater than the work done per unit area of the outer bit. The inner bit may be configured to steer the drill bit assembly. In some embodiments, the inner bit may push off the outer bit to steer. The inner bit may push the outer bit through a ring intermediate the inner bit and the outer bit.

In another aspect of the present invention, a method of increasing rate of penetration in downhole drilling comprises the steps of providing an outer bit with an outer cutting area, providing an inner bit disposed within the outer bit and having a inner cutting area, protruding the inner bit from the outer bit, and rotating the inner bit at a higher angular speed than the outer bit.

The step of providing an inner bit may include providing an eccentric inner bit with respect to the outer bit. The step of protruding the inner bit from the outer bit may include hammering the inner bit into a formation. The method may further comprise providing a center indenter disposed in the inner bit, and the center indenter is configured to hammer a formation. The step of rotating the inner bit at a higher angular speed than the outer bit may comprise rotating the inner bit with a torque transmitting device.

DETAILED DESCRIPTION OF THE INVENTION AND THE PREFERRED EMBODIMENT

Figure 1:
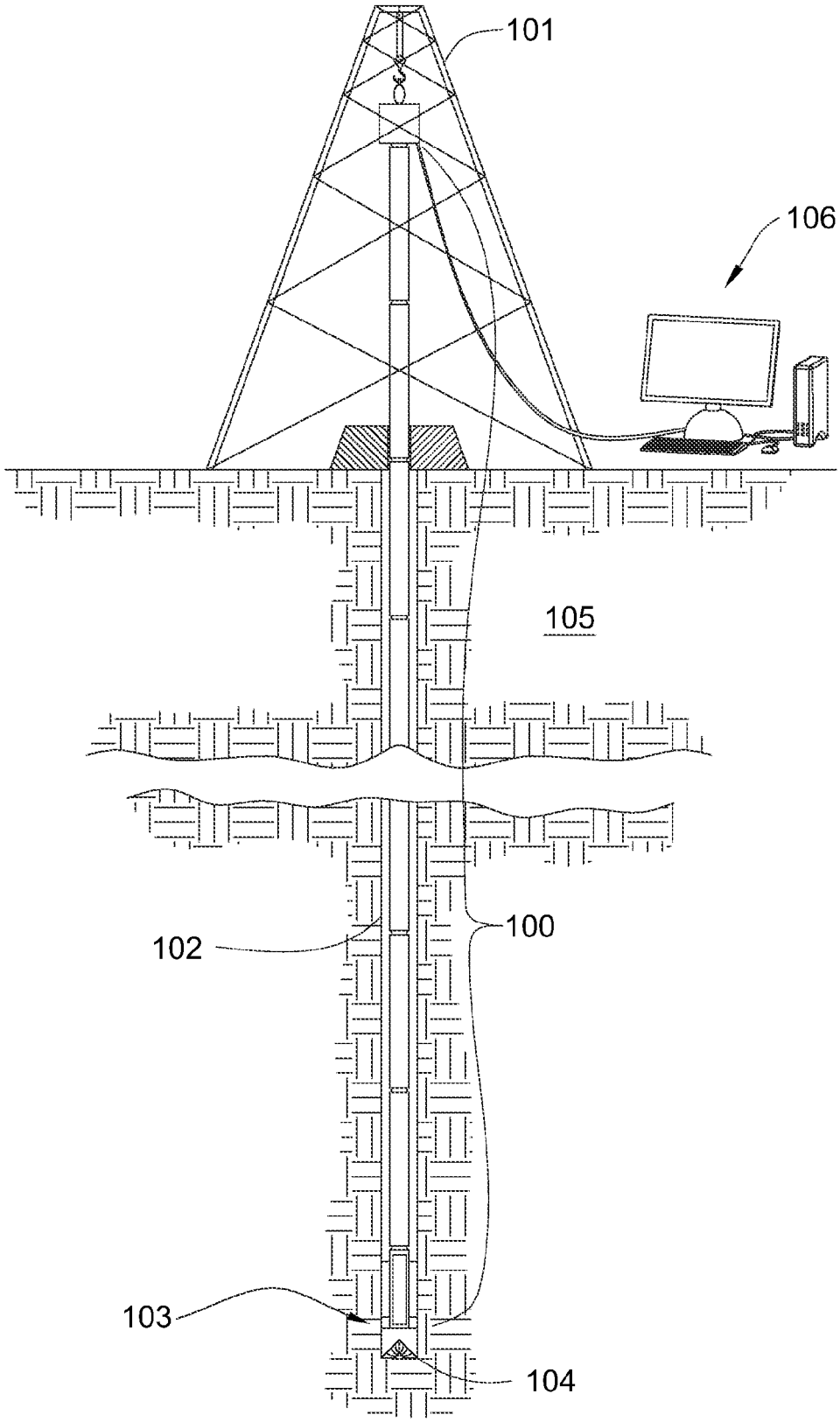
FIG. 1 is a perspective view of an embodiment of a drilling operation.

Referring now to the figures, FIG. 1 discloses a perspective view of an embodiment of a drilling operation comprising a downhole tool string 100 suspended by a derrick 101 in a bore hole 102. A drill bit assembly 103 may be located at the bottom of the borehole 102 and may comprise a drill bit 104. As the drill bit 104 rotates downhole the downhole tool string 100 advances farther into the earth. The downhole tool string 100 may penetrate soft or hard subterranean formations 105. The downhole tool string 100 may comprise electronic equipment able to send signals through a data communication system to a computer or data logging system 106 located at the surface.

Figure 2:
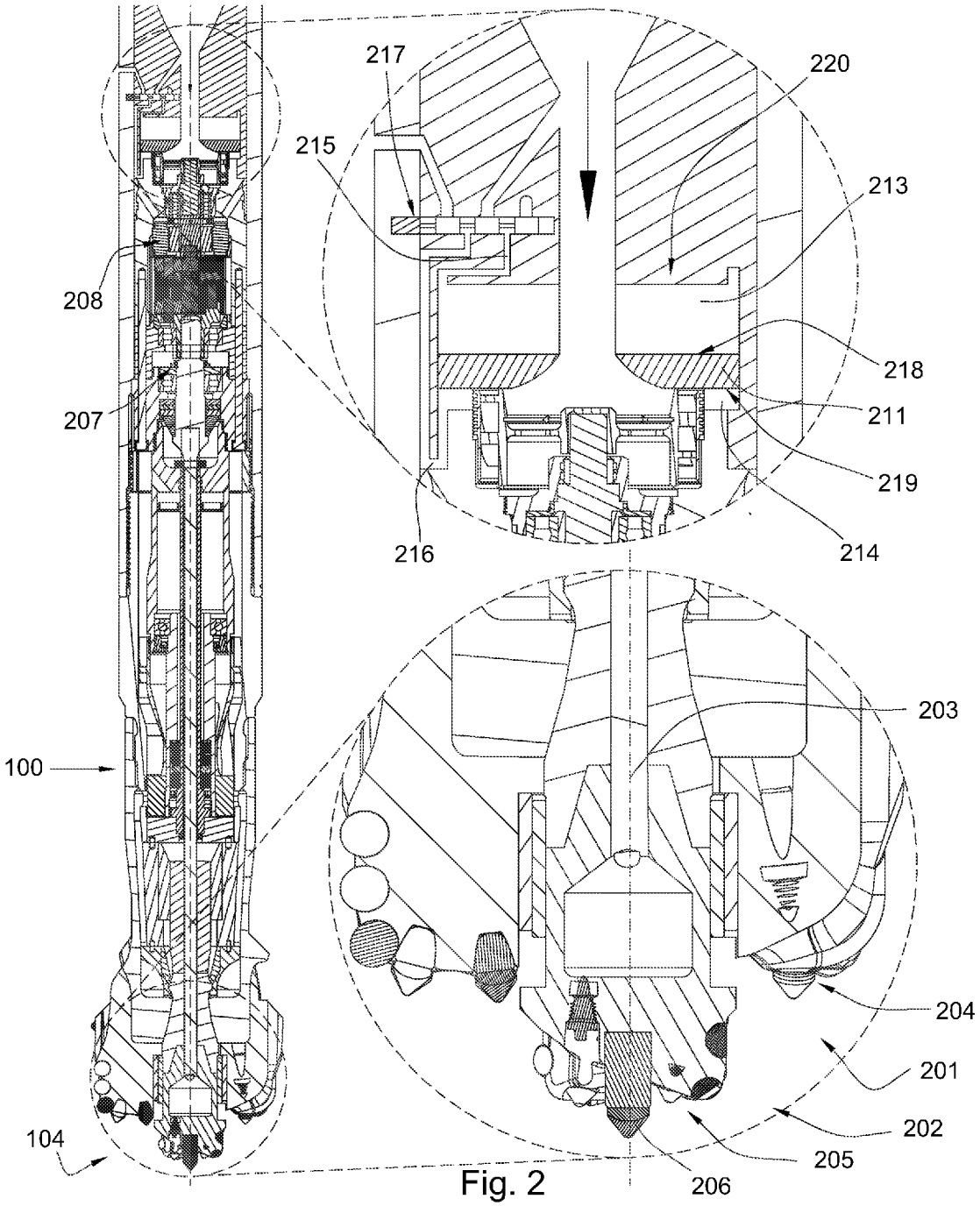
FIG. 2 is a cross-sectional view of an embodiment of a drill bit assembly.

FIG. 2 discloses a cross-sectional view of an embodiment of a drill bit 104. The drill bit 104 may comprise an outer bit 201 and an inner bit 202. The outer bit 201 may comprise a central axis 203 and a first plurality of cutting elements 204. The inner bit 202 may be disposed within the outer bit 201 and may comprise a second plurality of cutting elements 205 and a center indenter 206. The center indenter 206 may be the first to contact the formation (not shown) during normal drilling operation and may weaken the formation.

In this embodiment, the outer bit 201 is rigidly connected to the drill string 100 and the inner bit is rigidly connected to a torque transmitting device 207 disposed within the drill string 100. The torque transmitting device may be a mud driven motor, a positive displacement motor, a turbine, electric motor, or combinations thereof. The inner bit 202 and the torque transmitting device 207 may be substantially collinear with the central axis 203. The torque transmitting device 207 may comprise a gearbox 208 to apply a preferential torque to the inner bit.

The inner bit 202 may be rotationally isolated from the outer bit 201. When the inner bit 202 is rotationally isolated from the outer bit 201, the direction and speed of rotation of the inner bit 202 may be independent of the rotation of the outer bit 201. In this embodiment, the torque transmitting device 207 may exclusively control the direction and speed of the rotation of the inner bit 202. It is believed that having the inner bit 202 rotationally isolated from the outer bit 201 may be advantageous because the torque transmitting device 207 may rotate the inner bit 202 independent of the drill string 100. The outer bit 201 may be configured to rotate in a first direction controlled by the drill string 100 and the inner bit 202 may be configured to rotate in a second direction controlled by the torque transmitting device 207. The torque transmitting device 207 may be rotationally isolated from the drill string 100 such that the torque transmitting device 207 may rotate the inner bit 202 in the second direction without compensating for the drill string's rotation.

This embodiment also discloses the inner bit 202 protruding from the outer bit 201. The inner bit 202 may be configured to move axially with respect to the outer bit 201 such that the inner bit 202 may protrude and retract within the outer bit 201. The torque transmitting device 207 and the inner bit 202 may be rigidly connected to a piston 211 in a piston cylinder 220. The piston 211 may comprise a first surface 218 and a second surface 219. The piston 211 may separate the cylinder into a first pressure chamber 213 and a second pressure chamber 214. A first fluid channel 215 may connect the first pressure chamber 213 to at least one valve 217 and second fluid channel 216 may connect the second pressure chamber 214 to the at least one valve 217. The at least one valve 217 may control the flow of drilling fluid to the first the second fluid channels 215, 216 to control the axial displacement of the piston by forcing the fluid against first and second piston surfaces 218, 219. As fluid enters either the first or second pressure chambers 213, 214, fluid in the other chamber is exhausted out of the cylinder.

A method of increasing rate of penetration in downhole drilling may comprise protruding the inner bit 202 from the outer bit 201 and rotating the inner bit 202 at a higher angular speed than the outer bit 201. The step of rotating the inner bit 202 at a higher angular speed then the outer bit 201 may comprise rotating the inner bit 202 with the torque transmitting device 207 as the drill string 100 rotates the outer bit 201. It is believed that protruding the inner bit 202 from the outer bit 201 and rotating the inner bit 202 at a higher angular speed than the outer bit 201 allows the inner bit 202 to weaken the formation (not shown). The outer bit 201 may degrade the weakened formation at a higher rate than the outer bit 201 would if formation had not been weakened by the formation.

Figure 3:
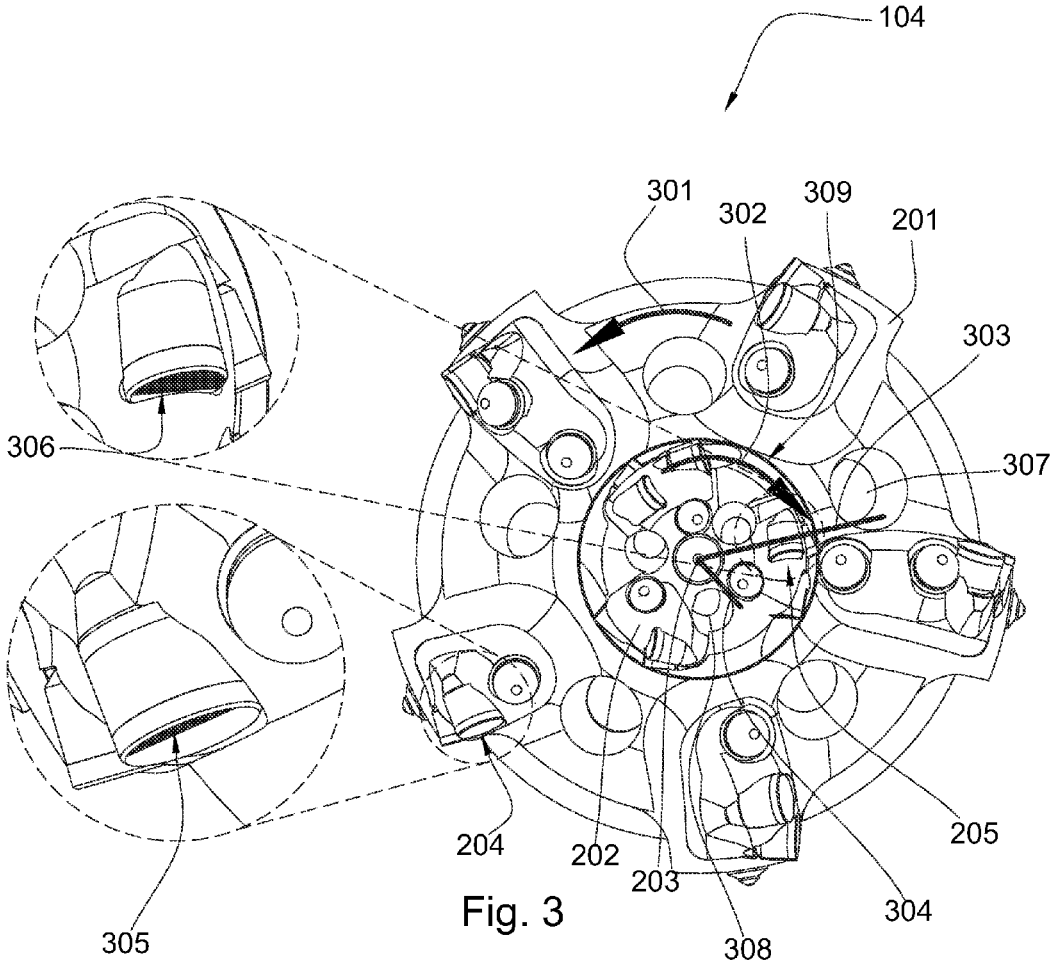
FIG. 3 is an orthogonal view of an embodiment of a drill bit.

FIG. 3 discloses an orthogonal view of an embodiment of the drill bit 104 comprising the outer bit 201 and the inner bit 202. In this embodiment, the outer bit 201 is configured to rotate in the first direction 301 and the inner bit 202 is configured to rotate in the second direction 302. The inner bit 202 may be disposed coaxial with the outer bit 201 such that the central axis 203 is the axis of rotation for both the outer bit 201 and the inner bit 202.

The outer bit 201 may comprise a first plurality of cutting elements 204 wherein an average distance of each cutting element 204 in the first plurality to the central axis 203 forms a first moment arm 303. Each cutter 204 in the first plurality of cutting elements contains an area of engagement 305 which may be the area that would be engaged in the formation (not shown) when the outer bit 201 is fully engaged. The sum of each area of engagement 305 disposed on the outer bit 201 forms the outer cutting area. The inner bit 202 may comprise a second plurality of cutting elements 205 wherein an average distance of each cutting element 205 in the second plurality to the central axis 203 forms a second moment arm 304. Each cutter 205 in the second plurality of cutting elements contains an area of engagement 306 which may be the area that would be engaged in the formation when the inner bit 202 is fully engaged. The sum of each area of engagement 306 disposed on the inner bit 202 forms the inner cutting area.

A ratio of the inner cutting area to the outer cutting area may be substantially equal to a ratio of the outer moment arm 303 to the inner moment arm 304. It is believed that having the ratio of the inner cutting area to the outer cutting area substantially equal to the ratio of outer moment arm 303 to the inner moment arm 304 may create an advantageous drill bit 104 when the outer drill bit 201 is rotating in the first direction 301 and the inner bit 202 is rotating in the second direction 302. This drill bit 104 may be effective in engaging the formation because the inner bit 202 may engage and weaken the formation without creating additional torsion in the drill string. During normal drilling operations, forces may act on the outer bit 201 and the inner bit 202. When the ratio of the inner cutting area to the outer cutting area is substantially equal to the ratio of the outer moment arm 303 to the inner moment arm 304, the forces acting on the outer bit 201 and the inner bit 202 may partly cancel each other out. It is believed that if the forces acting on the outer bit 201 partly cancel out the forces acting on the inner bit 202 then the drill bit 104 may engage the formation more efficiently. The area of engagement may be include shear cutters, diamond enhanced cutters, pointed cutters, rounded cutters or combinations thereof.

Preferably, the preferred embodiment includes shear cutters and pointed cutters. The pointed cutters may be better suited for the inner portions of both the working face of the inner and outer bit, while the shear cutters may be better suited for the gauge portions of the inner and outer bit. The pointed cutters preferably comprise a rounded apex that with a radius of curvature between 0.050 and 0.120 inch radius.

The curvature of radius may be formed along a plane formed along a central axis of the cutter. The shear cutters may have sharp, chamfered, or rounded edges.

This embodiment further discloses at least one fluid nozzle 307 disposed on the outer bit 201 and at least one fluid nozzle 308 disposed on the inner bit 202. A fluid pathway 309 may be disposed between the outer bit 201 and the inner bit 202. During normal drilling operations, the degraded formation may be removed from the bottom of the bore hole to allow for greater drilling effectiveness. Fluid from the at least one fluid nozzle 307 and the at least one fluid nozzle 308, or from the fluid pathway 309 may remove the degraded formation from the bottom of the bore hole through an annulus of the bore hole.

Figure 4:
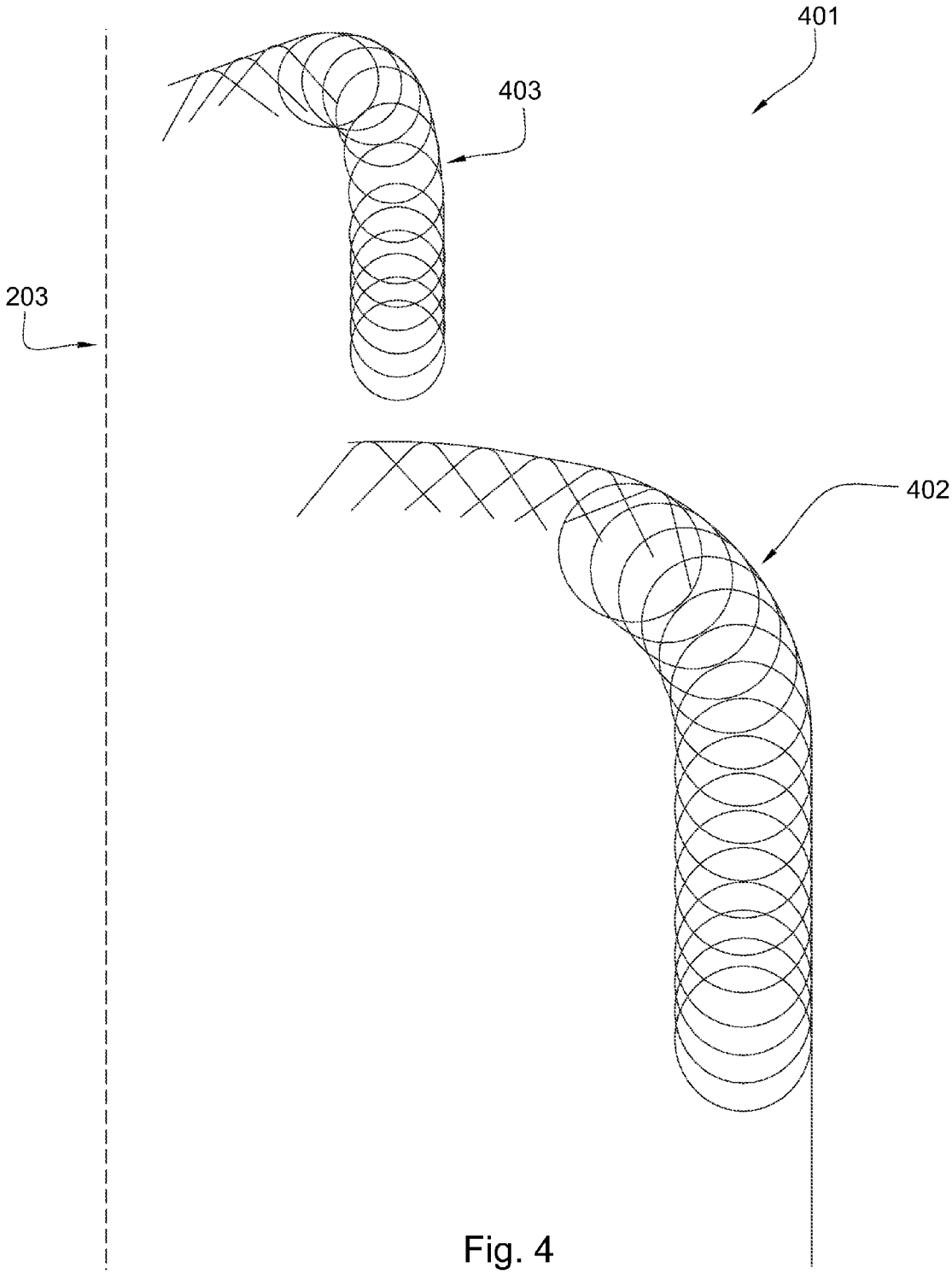
FIG. 4 is a diagram of an embodiment of a cutter profile.

FIG. 4 discloses an embodiment of a cutter profile 401 relative to the central axis 203. The cutter profile 401 may comprise an outer bit profile 402 and an inner bit profile 403. The outer bit profile 402 and the inner bit profile 403 may overlap. It is believed that overlapping the outer bit profile 402 and the inner bit profile 403 may increase the service life of the drill bit. This may provide redundancy at the transition between the outer bit and the inner bit. By overlapping the outer bit profile 402 and the inner bit profile 403, the transition may be reinforced such that even if a first cutter breaks off, a second cutter may become engaged in the formation.

Figure 5:
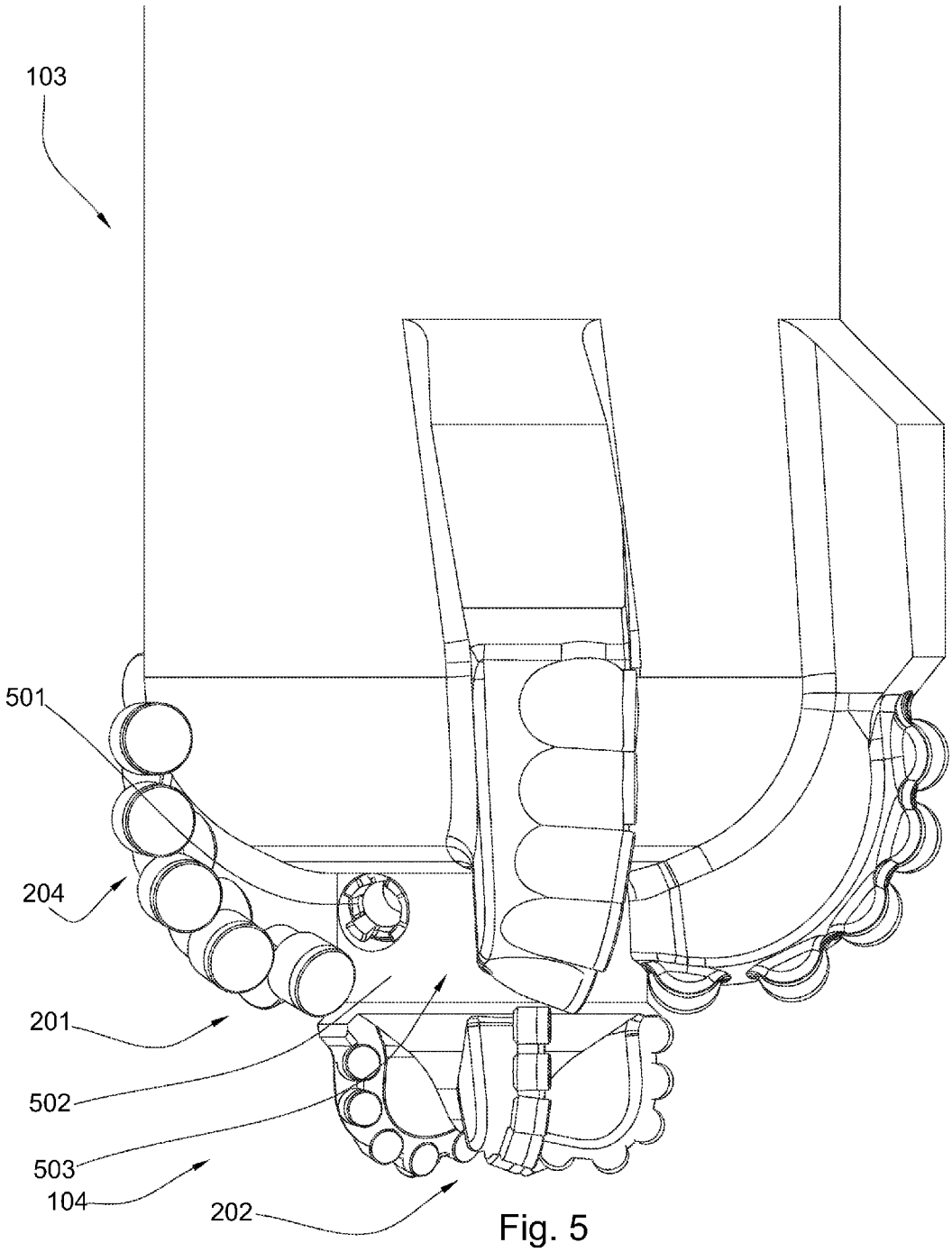
FIG. 5 is an orthogonal view of an embodiment of a drill bit assembly.

FIG. 5 discloses an orthogonal view of an embodiment of the drill bit assembly 103 comprising the drill bit 104. At least one fluid nozzle 501 may be incorporated in a gauge 502 of the inner bit 202. The at least one nozzle 501 may be configured to convey fluid across a working face 503 of the outer bit 201. The at least one fluid nozzle 501 may be aligned such that fluid may pass over the first plurality of cutters 204. During normal drilling operation, pieces of the formation may be deposited onto the first plurality of cutters 204 causing the first plurality of cutters 204 to engage in the formation less effectively. Fluid may be expelled from the at least one nozzle 501 such that the fluid directly or tangentially strikes the first plurality of cutters 204 removing any formation deposited on the first plurality of cutters 204. Fluid from the at least one nozzle 501 may also remove degraded formation from the bottom of the bore hole through an annulus of the bore hole.

Figure 6A:
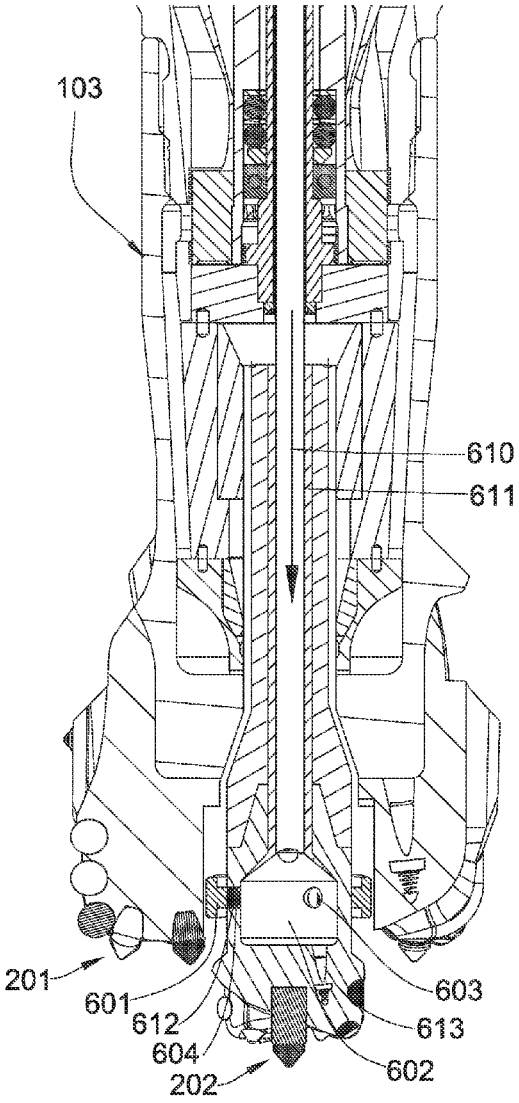
FIG. 6 is a cross-sectional view of an embodiment of a drill bit assembly.
Figure 6B:
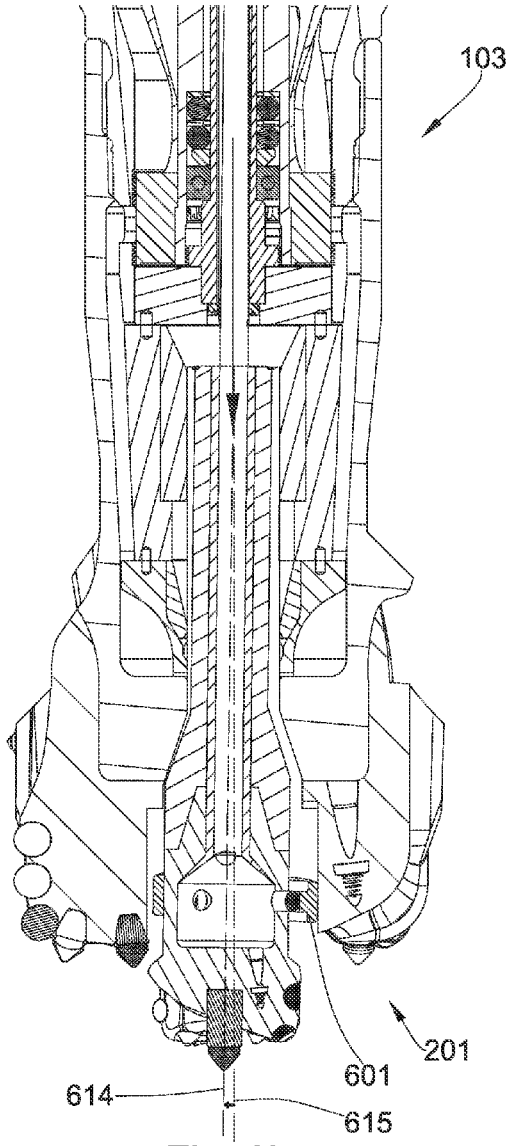

FIG. 6*a* and FIG. 6*b* disclose cross-sectional views of an embodiment of the drill bit assembly 103. The inner bit 202 may be configured to steer the drill bit assembly 103 by pushing off an inner diameter formed by the outer bit 201. In this embodiment, the inner bit 202 may push the inner diameter of outer bit 201 through a ring 601 disposed intermediate the inner bit 202 and the outer bit 201. Fluid may flow through a fluid passage 610 into a fluid chamber 602. The fluid chamber 602 may be disposed within the inner bit 202 and may comprise a plurality of ports 603. The fluid chamber 602 may be rigidly connected to a drive shaft 611 and in communication with a direction and inclination package (not shown), which may rotate the fluid chamber 602 independently of the inner bit 202. Because the fluid chamber 602 may rotate independently of the inner bit 202, the fluid chamber 602 may rotate to align and misalign the plurality of ports 603 with a plurality of channels 604. Fluid may flow through the at least one of the plurality of channels 604 and apply pressure to a bearing 612. The bearing 612 may then apply pressure to the ring 601 causing the ring 601 to push against an inner diameter formed by the outer bit 201 and steer the drill bit assembly 103. Fluid may constantly flow through the fluid passage 610 and when a straight trajectory is required, the fluid chamber 602 may rotate such that a substantially equal amount of fluid flows through each port of the plurality of ports 603 and each channel of the plurality of channels 604.

FIG. 6*b* discloses an embodiment of the drill bit assembly 103 wherein the ring 601 is steering the drill bit assembly 103. In this embodiment, as the ring 601 pushes off of the inner diameter of the outer bit 201, the central axis of the drill bit assembly 103 changes from being aligned with the axis 615 to being aligned with the axis 614.

Figure 7:
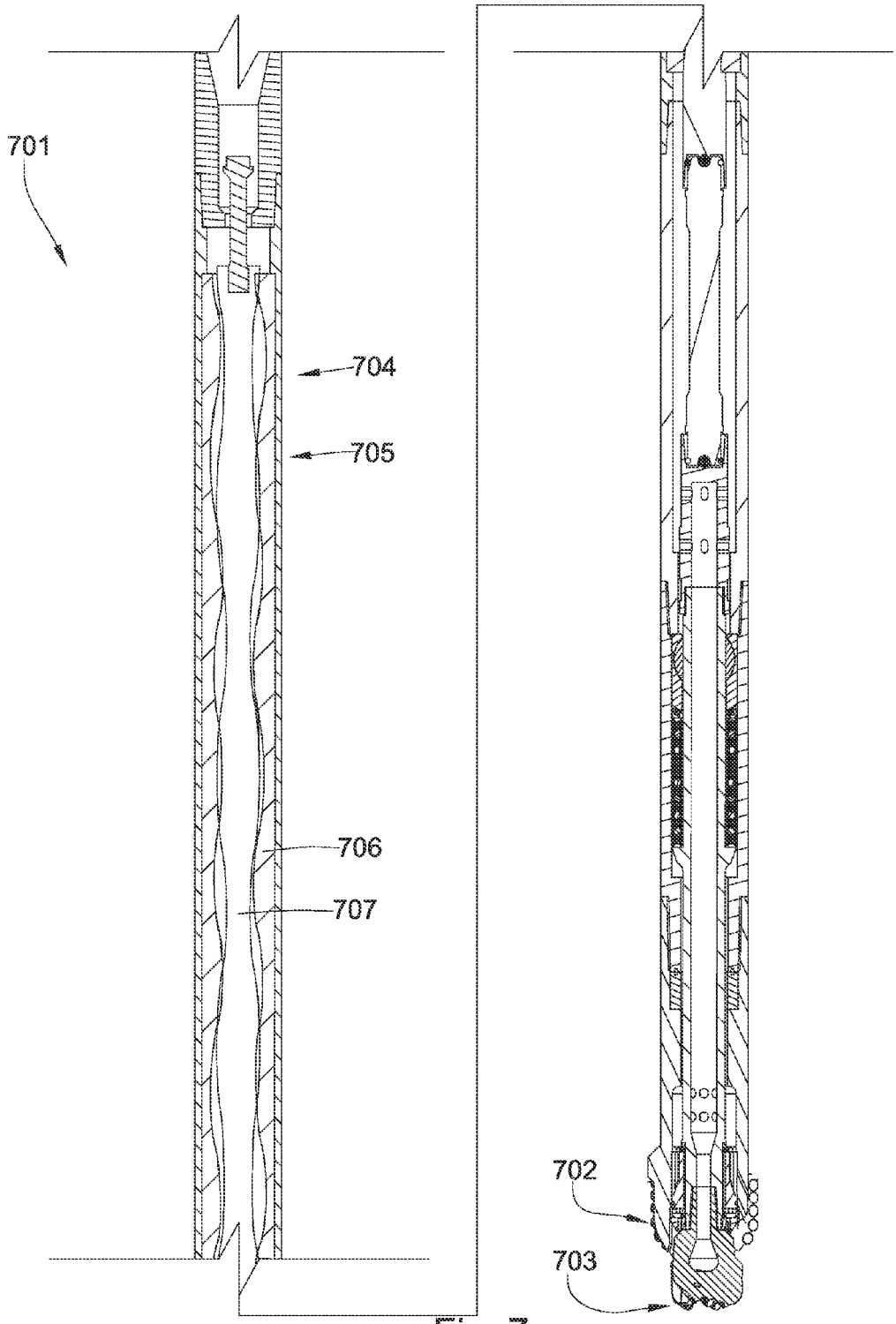
FIG. 7 is a cross-sectional view of an embodiment of a drill bit assembly.
Figures 8A, 8B:
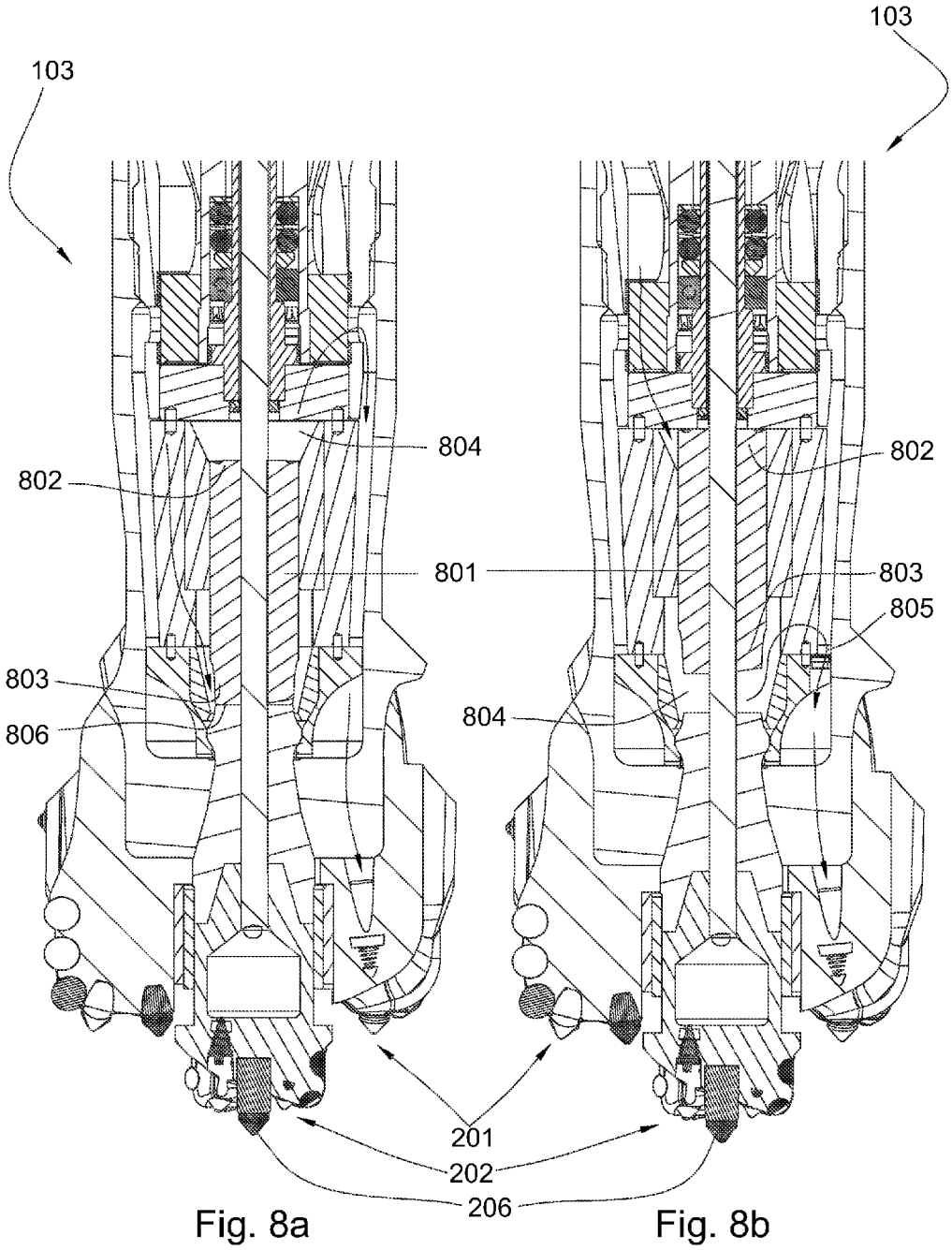
FIG. 8*a* is a cross-sectional view of an embodiment of a drill bit assembly.
FIG. 8*b* is a cross-sectional view of another embodiment of a drill bit assembly.

FIG. 7 discloses a cross-sectional view of an embodiment of a drill bit assembly 701 comprising an outer bit 702 and the inner bit 703. The drill bit assembly 701 may comprise a torque transmitting device 704. In this embodiment, the torque transmitting device 704 is a positive displacement motor 705. The positive displacement motor 705 may comprise a stator 706 and a rotor 707. The outer bit 702 may be rigidly connected to the stator 706 and the inner bit 703 may be rigidly connected to the rotor 707. The stator 706 may be rigidly connected to the top drive (not shown) located at the surface such that the stator 706 rotates as the top drive rotates the drill string. During normal drilling operations, the stator 706 may rotate the outer bit 702 and the rotor 707 may rotate the inner bit 703. The torque transmitting device 704 may be configured to provide the inner bit 703 with power such that work done per unit area of the inner bit 703 is greater than the work done per unit area of the outer bit 702. It is believed that if the work done per unit of the inner bit 703 is greater than the work done per unit area of the outer bit 702, then the drill bit 701 may cut more effectively. The drill bit 701 may cut more effectively because the inner bit 703 may weaken the formation, but may allow the outer bit 702 to engage and break up the formation. FIG. 8*a* and FIG. 8*b* are cross-sectional views of embodiments of the drill bit assembly 103 comprising the outer bit 201 and the inner bit 202. In the method of increasing rate of penetration, the step of protruding the inner bit 202 from the outer bit 201 may comprise hammering the inner bit 202 into the formation. The method may further comprise disposing a center indenter 206 in the inner bit 202. The center indenter 206 may be configured to hammer the formation.

In this embodiment, a hammering piston 801 may be in mechanical communication with the inner bit 202. The hammering piston 801 may comprise a first piston end 802 and a second piston end 803. The hammering piston 802 may be disposed within a pressure-sealed cylinder 804. Drilling fluid may be routed into the pressure-cylinder to axially move the piston. As the piston moves downward during a stroke portion of the piston's movement, the second piston end strikes a hammering surface 806 of the inner bit. This strike generates a pressure wave, which is transmitted into the formation through the inner and/or the indenter. The pressure-sealed cylinder 804 may comprise at least one exhaust port 805 to exhaust the drilling fluid out of the cylinder to accommodate the piston's movement. FIG. 8*a* shows the hammering piston 801 in an extended position while FIG. 8*b* shows the hammering piston in a retraced position.

Figure 9:
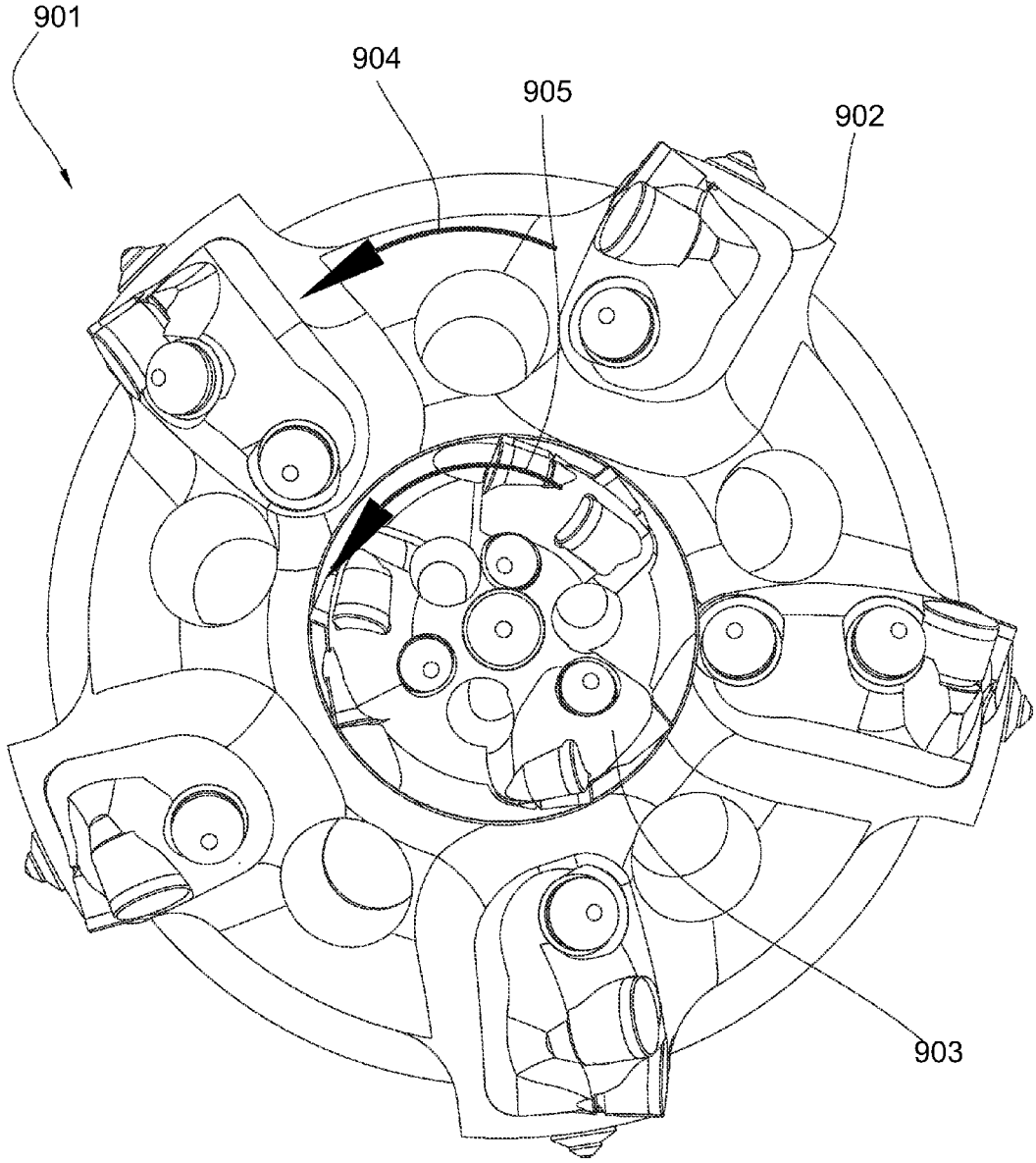
FIG. 9 is an orthogonal view of an embodiment of a drill bit.

FIG. 9 discloses an orthogonal view of an embodiment of a drill bit 901 comprising the outer bit 902 and the inner bit 903. In this embodiment, the outer bit 902 and the inner bit 903 are configured to rotate in the same direction. It is believed that when the outer bit 902 and the inner bit 903 are configured to rotate in the same direction, the life of the drill bit assembly may increase when the inner bit 903 is rotated at a high angular speed. The torque transmitting device may apply a lower torque to the inner bit while still rotating the inner bit at a higher RPM. Since the inner bit is lighter and cuts a smaller area, less power is required to drill with the inner than with the outer bit. Therefore, the formation may be weakened for the outer bit. Overall, this drilling approach may be more energy efficient than the more traditional solid faced drill bits. I Where the current figures disclose only two bits within the drill bit assembly (outer and inner bits) the current invention contemplates an unlimited number of bits. For example, an intermediate bit between the inner and outer bit may also comprise a substantially equal moment arm and area cutting ratio with the inner and outer bits. The inner bit may weaken the formation for the intermediate bit, and the intermediate bit may weaken the formation for the outer bit. Each bit may be rotated independently, in the same or opposing directions as the others. In this manner, the formation may be drilled in a more energy efficient manner.

Figure 10:
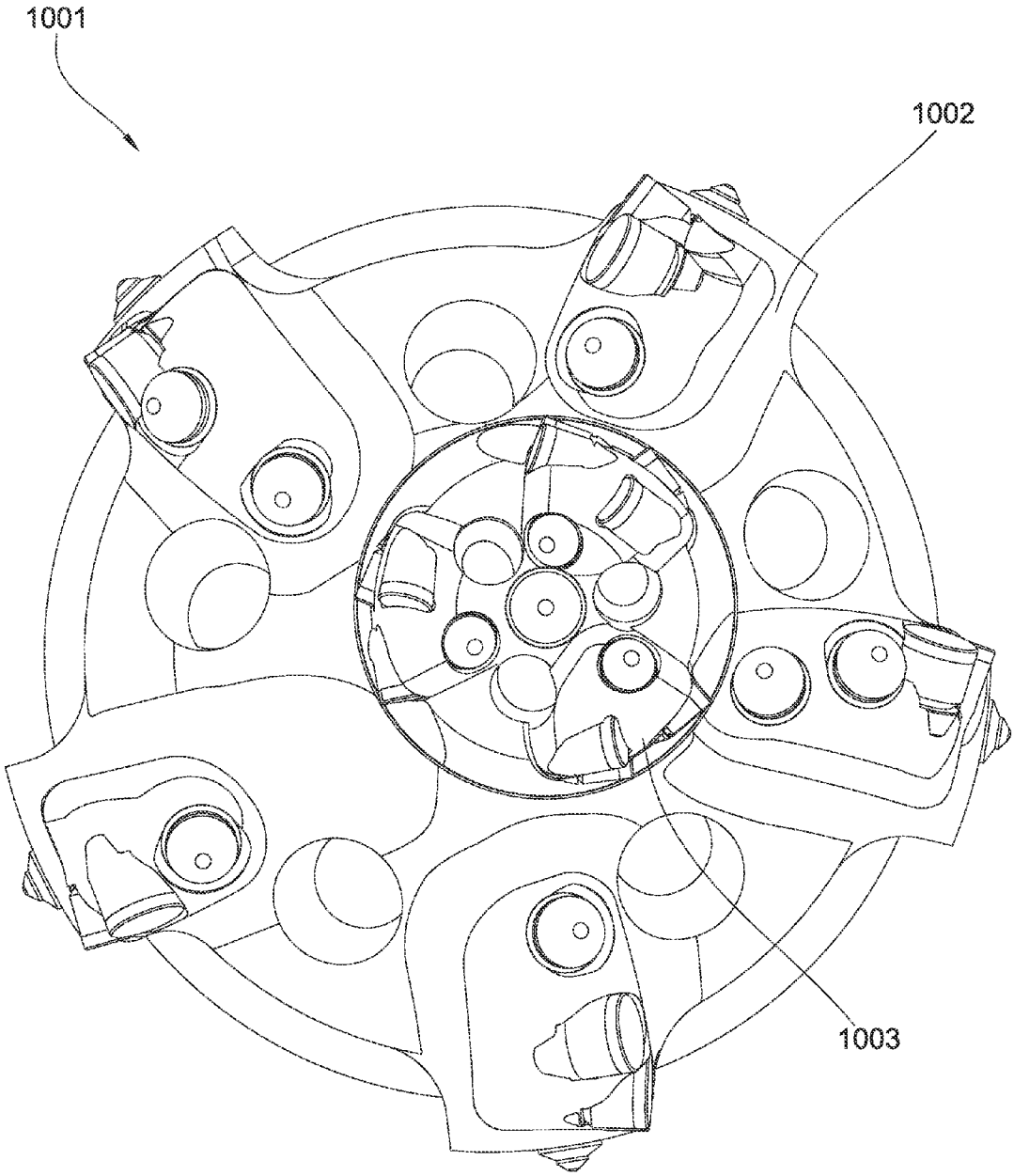
FIG. 10 is an orthogonal view of an embodiment of a drill bit.

FIG. 10 discloses an orthogonal view of an embodiment of a drill bit 1001 comprising the outer bit 1002 and the inner bit 1003. The inner bit 1003 may protrude from the outer bit 1002. The inner bit 1003 may be disposed eccentric with respect to the outer bit 1002. During normal drilling operations, the inner bit 1003 may rotate around the center axis of the outer bit 1002. In another embodiment, the drill bit 1001 may comprise hammering the inner bit 1003 into a formation at a location in the nutating rotation. Hammering the inner bit 1003 into the formation and rotating the inner bit 1003 around the center axis may allow the inner bit 1003 to weaken the formation.

Whereas the present invention has been described in particular relation to the drawings attached hereto, it should be understood that other and further modifications apart from those shown or suggested herein, may be made within the scope and spirit of the present invention.

What is claimed is:

1. A drill bit assembly for downhole drilling, comprising:

an outer bit comprising a central axis and an outer cutting area;

an inner bit disposed within the outer bit and comprising an inner cutting area;

the outer bit comprising a first plurality of cutting elements and the inner bit comprising a second plurality of cutting elements;

an average distance of each cutting element in the first plurality to the central axis forms a first moment arm;

an average distance of each cutting element in the second plurality to the central axis forms a second moment arm;

a ratio of the inner cutting area to the outer cutting area is substantially equal to a ratio of the inner moment arm to the outer moment arm.

2. The drill bit assembly of claim 1, wherein the inner bit is disposed coaxial with the outer bit.

3. The drill bit assembly of claim 1, wherein the outer bit is configured to rotate in a first direction and the inner bit is configured to rotate in a second direction.

4. The drill bit assembly of claim 1, wherein the inner bit protrudes from the outer bit.

5. The drill bit assembly of claim 4, further comprising an outer bit profile and a inner bit profile, wherein the outer bit profile and the inner bit profile overlap.

6. The drill bit assembly of claim 1, wherein the inner bit is configured to move axially with respect to the outer bit.

7. The drill bit assembly of claim 1, wherein the inner bit is rotationally isolated from the outer bit.

8. The drill bit assembly of claim 1, wherein the outer bit is rigidly connected to a drill string and the inner bit is rigidly connected to a torque transmitting device disposed within a bore hole of the drill string.

9. The drill bit assembly of claim 8, wherein the torque transmitting device is configured to provide the inner bit with power such that work done per unit area of the inner bit is greater than work done per unit area of the outer bit.

10. The drill bit assembly of claim 1, wherein the inner bit comprises a center indenter.

11. The drill bit assembly of claim 1, further comprising at least one fluid nozzle disposed on both the outer bit and the inner bit.

12. The drill bit assembly of claim 1, wherein at least one fluid nozzle is incorporated in a gauge of the inner bit, wherein the nozzle is configured to convey fluid across a working face of the outer bit.

13. The drill bit assembly of claim 1, further comprising a fluid pathway disposed between the outer bit and the inner bit.

14. The drill bit assembly of claim 1, wherein the inner bit is configured to steer the drill bit assembly by pushing off the outer bit.

15. The drill bit assembly of claim 14, wherein the inner bit pushes the outer bit through a ring intermediate the inner bit and the outer bit.

* * * * *